US009556820B2

(12) United States Patent
Birkigt et al.

(10) Patent No.: US 9,556,820 B2
(45) Date of Patent: Jan. 31, 2017

(54) CYLINDER OF A COMBUSTION ENGINE FOR A VEHICLE AND CORRESPONDING MANUFACTURING METHOD, MEANS FOR MANUFACTURING THE CYLINDER, SPARK PLUG, COMBUSTION ENGINE AND VEHICLE

(71) Applicants: Andreas Birkigt, Wolfsburg (DE); Lars Hentschel, Braunschweig (DE); Martin Stolle, Wolfsburg (DE); Claudio-Sebastian Sonder, Lehre (DE)

(72) Inventors: Andreas Birkigt, Wolfsburg (DE); Lars Hentschel, Braunschweig (DE); Martin Stolle, Wolfsburg (DE); Claudio-Sebastian Sonder, Lehre (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 14/088,276

(22) Filed: Nov. 22, 2013

(65) Prior Publication Data

US 2014/0076261 A1 Mar. 20, 2014

Related U.S. Application Data

(63) Continuation of application No. PCT/EP2012/002103, filed on May 16, 2012.

(30) Foreign Application Priority Data

May 27, 2011 (DE) ..... 10 2011 102 620

(51) Int. Cl.
*F02F 1/18* (2006.01)
*F02P 13/00* (2006.01)
(Continued)

(52) U.S. Cl.
CPC ..... *F02F 1/18* (2013.01); *F02F 1/242* (2013.01); *H01T 13/08* (2013.01); *H01T 13/16* (2013.01); *Y10T 29/4927* (2015.01)

(58) Field of Classification Search
CPC ..... H01T 13/16; H01T 13/08; F02F 1/18; F02F 1/242; F02B 77/005; F02B 77/00; F02P 13/00
(Continued)

(56) References Cited

U.S. PATENT DOCUMENTS 2,534,860 A * 12/1950 Fisher ..... 123/41.17
3,492,977 A * 2/1970 Fager ..... 123/41.32
(Continued)

FOREIGN PATENT DOCUMENTS

CN 101102035 A 1/2008
CN 101722319 A 6/2010
(Continued)

OTHER PUBLICATIONS

Search Report issued by the German Patent and Trademark Office for German Patent Application No. DE 10 2011 102 620.0 dated Aug. 10, 2011.
(Continued)

*Primary Examiner* — Grant Moubry
(74) *Attorney, Agent, or Firm* — Manfred Beck, P.A.

(57) ABSTRACT

A cylinder of a combustion engine for a vehicle includes at least one intake duct and a spark plug which in turn includes a ground electrode. The spark plug is mounted in the cylinder such that during an operation of the combustion engine the ground electrode is cooled in as optimum a manner as possible by an airflow generated by the at least one intake duct. A spark plug and a method for manufacturing a cylinder of a combustion engine are also provided.

7 Claims, 2 Drawing Sheets

(51) Int. Cl.
*F02F 1/24* (2006.01)
*H01T 13/08* (2006.01)
*H01T 13/16* (2006.01)

(58) Field of Classification Search
USPC ..... 123/41.32, 193.2, 41.31, 594
See application file for complete search history.

(56) References Cited

U.S. PATENT DOCUMENTS

| | | | | |
|---|---|---|---|---|
| 4,116,181 | A * | 9/1978 | Nakajima et al. | 123/310 |
| 4,133,331 | A * | 1/1979 | Otsubo et al. | 123/638 |
| 4,540,912 | A | 9/1985 | Matesco | |
| 4,553,515 | A * | 11/1985 | King et al. | 123/308 |
| 5,009,204 | A * | 4/1991 | Ishii | 123/193.5 |
| 5,813,385 | A * | 9/1998 | Yamauchi et al. | 123/276 |
| 5,873,341 | A | 2/1999 | Smith, Jr. et al. | |
| 6,360,587 | B1 | 3/2002 | Noel | |
| 8,104,445 | B2 * | 1/2012 | Seeger | 123/169 EA |
| 8,590,506 | B2 * | 11/2013 | Lee | F02B 17/005 123/299 |
| 8,662,025 | B2 * | 3/2014 | Taki | F02F 1/242 123/41.32 |
| 2008/0295792 | A1 | 12/2008 | Seeger | |
| 2010/0007261 | A1 | 1/2010 | Hartmann et al. | |
| 2010/0092255 | A1 | 4/2010 | Owusu et al. | |
| 2010/0108013 | A1 * | 5/2010 | Lee | F02B 17/005 123/188.8 |

FOREIGN PATENT DOCUMENTS

| | | | |
|---|---|---|---|
| DE | 649297 | C | 8/1937 |
| DE | 3939322 | C2 | 9/1994 |
| DE | 10138976 | A1 | 3/2002 |
| DE | 10338743 | A1 | 3/2005 |
| DE | 10349077 | A1 | 5/2005 |
| DE | 102007024878 | A1 | 12/2008 |
| DE | 102006042457 | B4 | 6/2010 |
| JP | 2004092410 | A | 3/2004 |
| JP | 2005299679 | A | 10/2005 |
| JP | 2007192133 | A | 8/2007 |
| JP | 2007303285 | A | 11/2007 |
| SU | 395151 | A1 | 8/1973 |

OTHER PUBLICATIONS

International Search Report for International Application No. PCT/EP2012/002103 and translation thereof, dated Sep. 26, 2012.

International Preliminary Report on Patentability for International Application No. PCT/EP2012/002103 including Written Opinion of the International Searching Authority and translation thereof, dated Dec. 2, 2013.

The Third Office Action issued by the State Intellectual Property Office of People's Republic of China, dated Sep. 23, 2016, which corresponds to Chinese Patent Application No. 201280025788.0 and is related to U.S. Appl. No. 14/088,276; with English language translation.

* cited by examiner

CYLINDER OF A COMBUSTION ENGINE FOR A VEHICLE AND CORRESPONDING MANUFACTURING METHOD, MEANS FOR MANUFACTURING THE CYLINDER, SPARK PLUG, COMBUSTION ENGINE AND VEHICLE

CROSS-REFERENCE TO RELATED APPLICATIONS

This application is a continuation, under 35 U.S.C. §120, of copending International Application No. PCT/EP2012/002103, filed May 16, 2012, which designated the United States; this application also claims the priority, under 35 U.S.C. §119, of German Patent Application No. DE 10 2011 102 620.0, filed May 27, 2011; the prior applications are herewith incorporated by reference in their entirety.

BACKGROUND OF THE INVENTION

Field of the Invention

The present invention relates to a cylinder of a combustion engine for a vehicle as well as to a manufacturing method which is configured for the manufacture of the cylinder. The invention also relates to means which are used for manufacturing the cylinder. Moreover, the present invention relates to a spark plug that can be accommodated in each case in a cylinder according to the invention. The invention also relates to a combustion engine and a vehicle that have a cylinder according to the invention.

German Patent No. DE 10 2006 042 457 B4, German Patent Application Publication No. DE 103 49 077 A1 and German Patent Application Publication No. DE 10 2007 024 878 A1 disclose arranging a spark plug in a cylinder in a specific alignment with respect to the intake valves of the cylinder.

German Patent Application Publication No. DE 101 38 976 A1 describes an apparatus for detecting a pre-ignition combustion in a combustion engine.

According to the prior art, a pre-ignition is known in which an uncontrolled ignition process of the cylinder charge occurs more or less dearly prior to the intended ignition time. Due to the premature conversion of the air-fuel mixture and the additional compression, there are in this case very high cylinder pressures. Due to the increased thermal state after the combustion start, there is often a detonation with a subsequent knocking combustion. The concurrence of these conditions can result in a cylinder pressure of greater than 25 MPa (250 bar) in an Otto cycle engine and thus result in an immediate failure of the engine.

SUMMARY OF THE INVENTION

It is accordingly an object of the invention to provide a cylinder configuration, which overcomes disadvantages of the heretofore-known cylinders of this general type, in particular a cylinder in which a pre-ignition occurs less frequently than in a comparable prior art cylinder. Another object of the invention is to provide a manufacturing method for manufacturing a cylinder configuration. A further object of the invention is to provide a spark plug for a cylinder.

With the foregoing and other objects in view there is provided, in accordance with the invention, in a combustion engine for a vehicle, a cylinder configuration including:

a cylinder including at least one intake duct and a spark plug;

the spark plug including a ground electrode; and the spark plug being mounted in the cylinder such that the spark plug has, with respect to the at least one intake duct, an orientation in a given orientation range in order to cool, during an operation of the combustion engine, the ground electrode by an airflow generated by the at least one intake duct.

In other words according to the invention, there is provided a cylinder of a combustion engine for a vehicle, wherein the cylinder includes at least one intake duct and a spark plug, and wherein the spark plug includes a ground electrode, wherein the spark plug is mounted in the cylinder such that the spark plug, with respect to the at least one intake duct, has an orientation in a predetermined orientation range in order to cool, during the operation of the combustion engine, the ground electrode by an airflow generated by the at least one intake duct.

According to another feature of the invention, the ground electrode has an open end; and the spark plug is mounted in the cylinder such that the open end of the ground electrode is disposed with a given tolerance in a direction of (i.e. directed toward) the at least one intake duct.

According to yet another feature of the invention, the at least one intake duct includes exactly two intake ducts. In this case, disposed with a given tolerance in a direction of the at least one intake duct means that the open end of the ground electrode is directed, with the given tolerance, between the two intake ducts.

According to a further feature of the invention, the given tolerance is within a range of ±90° to ±5°.

According to a further feature of the invention, the cylinder includes means configured to mount the spark plug in such a way in the cylinder such that the open end of the ground electrode is disposed, with the given tolerance, in the direction of the at least one intake duct.

According to another feature of the invention, the cylinder is formed with a mounting hole having an internal thread for receiving the spark plug; the spark plug has an external thread; the internal thread and the external thread are adapted to one another such that the spark plug, after a mounting during which the spark plug is screwed with a given torque into the internal thread, is aligned, with a tolerance, in a given direction with respect to the at least one intake duct.

With the objects of the invention in view there is also provided, a manufacturing method for manufacturing a cylinder configuration of a combustion engine for a vehicle, the method including the steps of:

providing a cylinder having at least one intake duct; and mounting a spark plug in such a manner in the cylinder such that it is ensured that the spark plug, with respect to the at least one intake duct, has an orientation in a given orientation range, in order to cool a ground electrode of the spark plug during an operation of the combustion engine by an airflow generated by the at least one intake duct.

In other words, according to the invention, there is provided a manufacturing method for manufacturing a cylinder of a combustion engine for a vehicle, wherein a spark plug is mounted in such a manner in the cylinder such that it is ensured that the spark plug, with respect to the at least one intake duct of the cylinder, has an orientation within a given orientation range, in order to cool, during the operation of the combustion engine, a ground electrode of the spark plug by an airflow generated by the at least one intake duct.

Another mode of the invention, includes mounting the spark plug in the cylinder such that it is ensured that an open end of the ground electrode is disposed with a given tolerance in a direction of the at least one intake duct.

Another mode of the invention, includes placing the spark plug in the cylinder by rotating the spark plug about a central longitudinal axis of the spark plug and rotating the spark plug so that the open end of the ground electrode points with the given tolerance in the direction of the at least one intake duct.

A further mode of the invention, includes providing the spark plug with an external thread; and screwing the spark plug with its external thread with a given torque into an internal thread of the cylinder wherein the internal thread and the external thread are adapted to one another such that the open end of the ground electrode, after the spark plug has been screwed into the internal thread, points, with the given tolerance, in the direction of the at least one intake duct.

A further mode of the invention, includes using means configured such that the means mount the spark plug in the cylinder in such a way that it is ensured that the spark plug, with respect to the at least one intake duct of the cylinder, has the orientation in the given orientation range, in order to cool, during the operation of the combustion engine, the ground electrode of the spark plug by the airflow generated by the at least one intake duct.

Thus, according to the invention, means are provided for producing a cylinder of a combustion engine for a vehicle, wherein the means are configured such that the means mount a spark plug in such a way in the cylinder that it is ensured that the spark plug, with respect to the at least one intake duct of the cylinder, has an orientation in a given orientation range, in order to cool, during the operation of the combustion engine, a ground electrode of the spark plug by an airflow generated by the at least one intake duct.

With the objects of the invention in view there is also provided, a manufacturing method in accordance with any of the modes defined above wherein the manufacturing method is configured for manufacturing an embodiment of the cylinder according to the invention.

With the objects of the invention in view there is further provided, in combination with a cylinder having at least one intake duct, a spark plug including:

a ground electrode, the spark plug being mounted in the cylinder such that the spark plug has, with respect to the at least one intake duct, an orientation in a given orientation range in order to cool the ground electrode by an airflow generated by the at least one intake duct; and a thread having a surface with a profile, the profile of the surface of the thread being a rolled profile.

In other words, according to the invention, there is provided a spark plug for a cylinder of a combustion engine for a vehicle, wherein the spark plug is mounted in the cylinder such that the spark plug, with respect to the at least one intake duct, has an orientation in a predetermined orientation range in order to cool, during the operation of the combustion engine, the ground electrode of the spark plug by an airflow generated by the at least one intake duct, and wherein the thread of the spark plug is configured such that the profile of the surface of the thread is rolled (i.e. the thread is a roped thread).

According to another feature of the invention, the spark plug includes:

a spark plug ceramic; and a spark plug collar extending on a combustion chamber side thereof so that the spark plug collar terminates at least with the spark plug ceramic or the spark plug collar protrudes to some extent beyond the spark plug ceramic.

With the objects of the invention in view there is also provided, a combustion engine for a vehicle having a cylinder, wherein the cylinder includes at least one intake duct and a spark plug, and wherein the spark plug includes a ground electrode, wherein the spark plug is mounted in the cylinder such that the spark plug, with respect to the at least one intake duct, has an orientation in a predetermined orientation range in order to cool, during the operation of the combustion engine, the ground electrode by an airflow generated by the at least one intake duct.

With the objects of the invention in view there is furthermore provided, a vehicle with a combustion engine as defined above.

In accordance with the present invention, a cylinder of a combustion engine for a vehicle is provided. The cylinder includes in this case one or more intake ducts and a spark plug. The spark plug in turn has a ground electrode. The spark plug is mounted in the cylinder in such a manner that the spark plug has, with respect to the at least one intake duct of the cylinder, an orientation in a predetermined orientation range (i.e. an alignment of the cylinder in a predetermined tolerance range (e.g. angle range)) in order to cool the ground electrode, when the combustion engine is running, with an airflow which is generated by the intake duct or intake ducts. That is, the spark plug is mounted or arranged in the cylinder such that the airflow generated by the at least one intake duct cools the ground electrode in as optimum a manner as possible taking into account tolerances during the mounting of the spark plug.

In other words, the basic idea of the present invention is to use the airflow, which is generated by the at least one intake duct during operation of the combustion engine, for cooling the ground electrode of the spark plug. In order to then determine the optimal orientation of the spark plug and thus of the ground electrode, in which the ground electrode is cooled the best by the airflow of the at least one intake duct, a number of orientations were examined in view of how hot the ground electrode gets in each case during operation of the combustion engine. In order to determine the optimal orientation of the spark plug, temperature measurements on the spark plug were carried out with an optically accessible engine, wherein a special measurement technique (infrared thermometry) was used.

The inventors of the present invention recognized that it is advantageous for the cooling of the ground electrode by the airflow of the at least one intake duct to attach or mount the spark plug in such a way in the cylinder that an open end of the ground electrode is essentially (i.e. with a predetermined tolerance) disposed in a direction toward the at least one intake duct.

In other words, the spark plug is mounted in such a manner in the cylinder (e.g. rotated) so that the open end (i.e. the unattached end) of the ground electrode is so directed towards the at least one intake duct, so that the airflow, which is flowing in via the at least one intake duct, impinges on the open end of the ground electrode and thereby cools it.

The inventors have investigated two different variants. In the first variant, the open end of the ground electrode was disposed in a direction of the intake valves and in the second variant in the direction of the exhaust valves. In the subsequent temperature measurement, the hottest spot of the ground electrode, which is usually located at the open end of the ground electrode, exhibited a temperature that was 40°

C. to 60° C. higher in case of the second variant than the temperature of the hottest point of the ground electrode in case of the first variant. The specific installation position of the spark plug with an alignment of the ground electrode in a direction of the intake valves (intake ducts) thus considerably reduces the temperature of the ground electrode in an advantageous manner, so that the maximum temperature of the spark plug, and thereby the frequency of pre-ignitions, can be significantly reduced.

If the at least one intake duct consists of exactly one intake duct, the open end of the ground electrode is directed precisely at this one intake duct. If, however, the at least one intake duct consists of exactly two intake ducts, the open end of the ground electrode is directed, raking into account the tolerance, between the two intake ducts.

The tolerance is advantageously at most ±90°, better yet ±45° and best of all ±5°.

If the tolerance is in accordance with the invention ±90° (±45° or, respectively, ±5°), the spark plug is rotated about its longitudinal central axis during the mounting in accordance with the invention such that, with respect to the optimal alignment in which the open end of the ground electrode is directed precisely at the intake duct (in case of exactly one intake duct) or precisely between the two intake ducts (in case of exactly two intake ducts), is turned maximally by 90° (45° or, respectively, 5°) clockwise or maximally by to 90° (45° or, respectively, 5°) counterclockwise. What is meant by precisely between the two intake ducts is in particular a point which is located between the two intake ducts on a straight line connecting the center of the outlet of one of the intake ducts into the combustion chamber with the center of the outlet of the other one of the intake ducts into the combustion chamber. In this case, this point has the same distance from the center of the outlet of the one intake duct and from the center of the outlet of the other intake duct.

In particular, the cylinder includes means in order to dispose the spark plug in the cylinder in accordance with the invention, so that the open end of the ground electrode, taking into account the tolerance, is disposed in the direction of the at least one intake duct.

These means may for example include certain markings in order to dispose the spark plug in the desired manner in the cylinder. A further possibility is that a defined stop is provided so that the spark plug, when it is mounted by taking into account this stop, is aligned toward the at least one intake duct in accordance with the invention.

A preferred embodiment in accordance with the invention for the means according to the invention is provided in that the cylinder (in particular the cylinder head) includes a mounting hole with an internal thread, which is configured for accommodating the spark plug. The spark plug includes in this case an external thread which is adapted to the internal thread such that, after the mounting during which the spark plug is screwed with a predetermined torque into the internal thread, the spark plug is aligned with the predetermined tolerance in the predetermined direction with respect to the at least one intake duct.

Because the internal thread of the cylinder and the external thread of the spark plug are accordingly adapted, i.e. in particular they are aligned in such a manner that the spark plug, in order to be mounted, must be disposed in a predetermined alignment with regard to the cylinder, so that the internal thread can be brought in engagement with the external thread, it is possible to set the end position (i.e. the position after the mounting) of the spark plug and thus the alignment of the open end of the ground electrode toward the at least one intake duct taking into account the tolerance.

In accordance with the scope of the present invention, also a manufacturing method for manufacturing a cylinder of a combustion engine for a vehicle is provided. According to this manufacturing method, a spark plug is mounted in the cylinder in such a manner that it is ensured that the spark plug has, with respect to one or more intake ducts of the cylinder, an orientation in a predetermined orientation range, so that when the combustion engine is running, a ground electrode of the spark plug is in as optimum a manner as possible cooled by the airflow generated by the at least one intake duct.

In other words, the manufacturing method ensures that the spark plug (in particular the open end of the ground electrode) has, after being mounted, the desired alignment with respect to the at least one intake duct. A manufacturing method that achieves this desired alignment only by chance (thus is not ensured for each cylinder) is, as per the above definition of the manufacturing method according to the invention, not a manufacturing method in accordance with the invention, because it does not ensure the desired alignment of the spark plug toward the at least one intake duct.

According to the manufacturing method of the invention, the spark plug is installed in particular by a rotation about the central longitudinal axis (or longitudinal central axis) of the spark plug in the cylinder. That is, the spark plug is screwed into the cylinder (in particular the cylinder head) by the rotation about the central longitudinal axis. The spark plug is in this case rotated in such a manner into an end position such that, taking into account the tolerance, the open end of the ground electrode points toward the at least one intake duct.

According to a preferred embodiment of the method according to the invention, the spark plug has an external thread and the cylinder has an internal thread. In this case, the internal thread and the external thread are adapted in such a manner to one another such that the open end of the ground electrode, due to the adaption of the internal thread to the external thread, points as it were in a constrained manner with the predetermined tolerance in the direction of the at least one intake duct, when the spark plug is screwed into the internal thread.

In accordance with the scope of the present invention, means for manufacturing a cylinder of a combustion engine for a vehicle are provided. In this case, the means are configured such that, with the help of these means, the spark plug can be mounted in such a way in the cylinder, such that it is ensured that the spark plug has, with regard to one or a plurality of intake ducts of the cylinder, an orientation in a predetermined orientation range, so that when the combustion engine is running, a ground electrode of the spark plug is in as optimum a manner as possible cooled by an airflow generated by the at least one intake duct.

As has already been explained above, the following possibilities exist for these means according to the invention:

- Markings, with which it is ensured that it is guaranteed that the spark plug has the desired alignment with respect to the at least one intake duct after the mounting, wherein these markings are taken into account during the mounting.
- A stop, with which it is ensured that the spark plug has the desired alignment with respect to the at least one intake duct when the spark plug is rotated as far as the stop.
- Aligned threads, i.e. in particular the adaptation of the external thread of the spark plug to the internal thread of the cylinder, as described above.

In accordance with the scope of the present invention, there is also provided a spark plug. The thread of the spark plug is in this case configured such that the profile of the surface of the thread is rolled. This thread is created by deforming a workpiece under enormous force application between two rotating rolling tools. Due to the penetration of the rolling tool profiles into the workpiece surface, the material is pressed in a cold condition down into the root of the thread rolling tools and is thus rolled up to the nominal dimension. After the rolling, the orientation of the thread is examined. With the knowledge of how the thread is configured at the respective spark plug, the ground electrode is subsequently attached (welded).

In addition, the collar of the spark plug metal housing is extended on the combustion chamber side so that the spark plug collar terminates with the spark plug ceramic, i.e. is flush with the spark plug ceramic, or protrudes to some extent beyond the spark plug ceramic. The spark plug ceramic as an insulator is thus shielded in the housing. Through the use of this configuration, the possible spark gap is changed so that in case of a high charge movement a possible creeping discharge does not take place via the ceramic, but is deflected to the metal housing. This ensures a reliable ignition of the mixture, and the ceramic is protected by this reliable ignition, because the ceramic is located at the same level or below the spark plug housing.

Furthermore, in accordance with the present invention, a combustion engine for a vehicle is provided, wherein the combustion engine includes a cylinder according to the invention, which is described above.

Finally, in accordance with the present invention, a vehicle is provided which includes a combustion engine according to the invention.

A clear trend could be observed in the course of investigations of pre-ignition. The colder the spark plug, the lower the frequency with which pre-ignitions occur for an operating point. It was recognized that the spark plug is the hottest component in the combustion chamber and thus supports a pre-ignition. Throughout the entire intake phase and compression phase, heat is transferred from the hot spark plug to the colder fuel-air mixture. The temperatures in the entire operating characteristic map are reduced due to the aligned installation of the spark plug in accordance with the invention. This reduction in temperature, in addition to reducing the probability of a pre-ignition, also reduces the susceptibility to glow ignitions, thermal overload, and resulting spark plug damages.

In summary, the present invention has in particular the advantage that the probability of the occurrence of a pre-ignition is reduced. In addition, the stress of the spark plug is advantageously reduced and thus the service life of the spark plug is extended.

The present invention is particularly suitable for a use in combustion engines of motor vehicles. The present invention is of course not limited to this preferred area of application, since the present invention is also suitable for combustion engines of ships, aircraft, and rail-mounted vehicles or railborne vehicles.

Other features which are considered as characteristic for the invention are set forth in the appended claims.

Although the invention is illustrated and described herein as embodied in a cylinder of a combustion engine for a vehicle and a corresponding manufacturing method, means for manufacturing the cylinder, a spark plug, an internal combustion engine and a vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
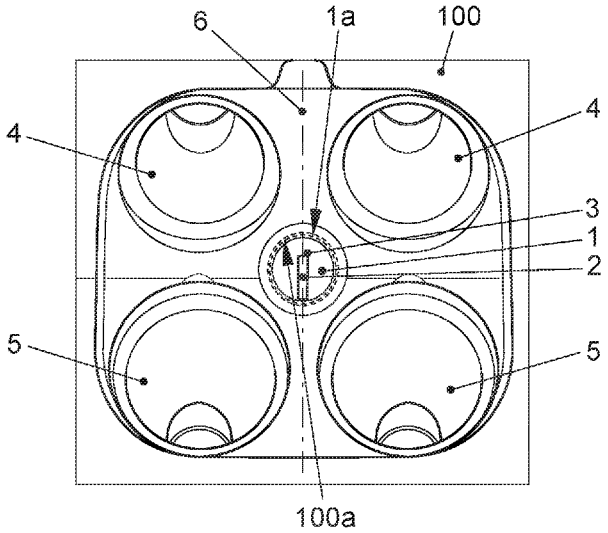
FIG. 1 is a diagrammatic plan view of a cylinder head as viewed from the interior space of the cylinder in accordance with the invention.

Referring now to the figures of the drawings in detail and first, particularly, to FIG. 1 thereof, there is shown a cylinder head 100 as viewed from the interior space of the cylinder. Two intake ducts 4 and two outlet ducts 5 can be seen, wherein a spark plug 1 is mounted symmetrically in the middle of these intake ducts 4 and outlet ducts 5. The cylinder is formed with a mounting hole having an internal thread 100*a* for receiving the spark plug 1. The spark plug 1 has an external thread 1*a*.

Figure 2:
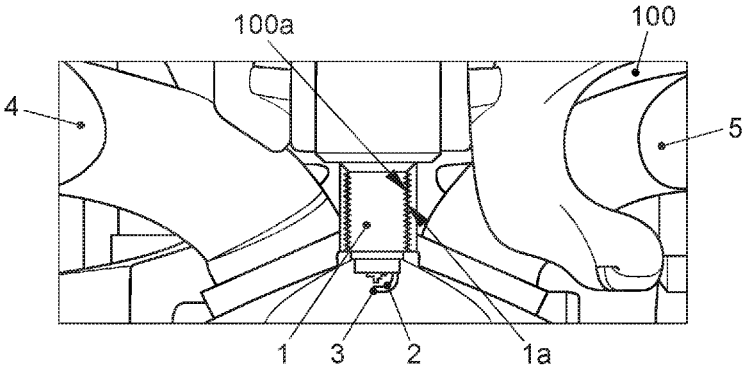
FIG. 2 is a diagrammatic sectional view of the cylinder head along section line 6 in FIG. 1 in accordance with the invention.

In FIG. 2, a sectional view is shown which depicts a section, represented by reference character 6 in FIG. 1, through the center of the cylinder head or, respectively, of the combustion chamber. Here, an intake duct 4 is shown on the left (in FIG. 2), an outlet duct 5 on the right, and the spark plug 1 in the middle. The ground electrode 2 of the spark plug 1 can be seen, wherein the ground electrode 2 is curved from the outer edge of the spark plug 1 toward the longitudinal central axis of the spark plug 1. The open end of the ground electrode 2, which is denoted by the reference character 3, is aligned exactly toward the left in the FIG. 2 (in other words exactly in the direction of the section 6). The open end 3 of the ground electrode 2 is therefore aligned exactly between the two intake ducts 4.

Figure 3:
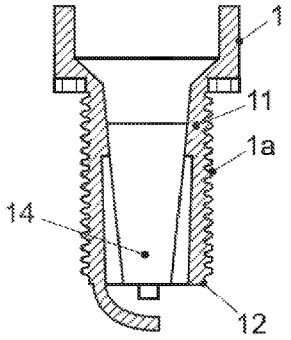
FIG. 3 is a diagrammatic sectional view of a spark plug according to the invention.

A section through the spark plug 1 is shown in FIG. 3. The spark plug collar 12 ends flush with the spark plug ceramic 14 or even protrudes beyond the spark plug ceramic 14. The spark plug ceramic 14 is shielded in the spark plug housing 11 and forms the insulator.

Figure 4:
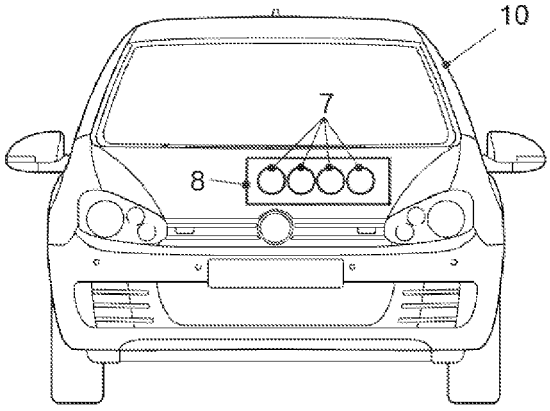
FIG. 4 is a schematic view of a vehicle according to the invention having a combustion engine in accordance with the invention.

A vehicle 10 in accordance with the invention which has a combustion engine 8 according to the invention is shown in FIG. 4. This combustion engine 8 in turn includes four cylinders 7 according to the invention.

What is claimed is:

1. In a combustion engine for a vehicle, a cylinder configuration comprising:

a cylinder including exactly two intake ducts and a spark plug;

said cylinder being formed with a mounting hole having an internal thread for receiving said spark plug;

said spark plug including a ground electrode, a spark plug collar, and an external thread;

said ground electrode having an open end;

said ground electrode being attached to said spark plug collar at a given circumferential location on said spark plug collar, said given circumferential location on said spark plug collar and said external thread being oriented in a predetermined spatial orientation with respect to one another, the predetermined spatial orientation ensuring that said open end of said ground electrode is directed, with a given tolerance, between said two intake ducts, when said spark plug is mounted in said internal thread of said cylinder; and said internal thread of said cylinder and said external thread of said spark plug being adapted to one another such that, when said spark plug is screwed with a given torque in said internal thread of said cylinder, said open end of said ground electrode is directed, with the given tolerance, between said two intake ducts in order to provide an increased cooling of said ground electrode, during an operation of the combustion engine, by an airflow generated by said two intake ducts.

2. The cylinder configuration according to claim 1, wherein the given tolerance is within a range of ±90° to ±5°.

3. A manufacturing method for manufacturing a cylinder configuration of a combustion engine for a vehicle, comprising the steps of:

providing a cylinder having exactly two intake ducts and a spark plug, the cylinder being formed with a mounting hole having an internal thread for receiving the spark plug, the spark plug including a ground electrode, a spark plug collar, and an external thread, the ground electrode having an open end; and mounting the spark plug in such a manner in the cylinder such that the ground electrode is attached to the spark plug collar at a given circumferential location on the spark plug collar, wherein the given circumferential location on the spark plug collar and the external thread are oriented in a predetermined spatial orientation with respect to one another, wherein the predetermined spatial orientation ensures that the open end of the ground electrode is directed, with a given tolerance, between the two intake ducts, when the spark plug is mounted in the internal thread of the cylinder, and wherein the internal thread of the cylinder and the external thread of the spark plug are adapted to one another such that, when the spark plug is screwed with a given torque in the internal thread of the cylinder, the open end of the ground electrode is directed, with the given tolerance, between the two intake ducts in order to provide an increased cooling of the ground electrode, during an operation of the combustion engine, by an airflow generated by the two intake ducts.

4. The manufacturing method according to claim 3, which comprises placing the spark plug in the cylinder by rotating the spark plug about a central longitudinal axis of the spark plug and rotating the spark plug so that the open end of the ground electrode points with the given tolerance between the two intake ducts.

5. The cylinder configuration according to claim 1, wherein said external thread of said spark plug has a surface with a profile, said profile of said surface of said external thread being a rolled profile.

6. The cylinder configuration according to claim 1, wherein said spark plug has a spark plug ceramic and a spark plug collar, and wherein said spark plug collar extends on a combustion chamber side thereof so that said spark plug collar terminates at least with said spark plug ceramic.

7. The cylinder configuration according to claim 1, wherein said spark plug has a spark plug ceramic and a spark plug collar, and wherein said spark plug collar extends on a combustion chamber side thereof so that said spark plug collar protrudes to some extent beyond said spark plug ceramic.

* * * * *